US005454535A

United States Patent [19]

Thomson et al.

[11] Patent Number: 5,454,535

[45] Date of Patent: Oct. 3, 1995

[54] LAWN REFUSE BAG HOLDER

[76] Inventors: William E. Thomson, 404 S. Broadway, Box 267; Keith A. Krohe, 500 S. John, Box 305, both of Table Grove, Ill. 61482

[21] Appl. No.: 222,921

[22] Filed: Apr. 5, 1994

[51] Int. Cl.[6] ..... B65B 67/04

[52] U.S. Cl. ..... 248/99

[58] Field of Search ..... 248/95, 97, 98, 248/100, 101, 156

[56] References Cited

U.S. PATENT DOCUMENTS

| | | | |
|---|---|---|---|
| 347,077 | 8/1886 | Wealand . | |
| 511,156 | 12/1893 | Newton | 248/95 |
| 1,556,462 | 10/1925 | Torske . | |
| 2,965,344 | 12/1960 | Baker . | |
| 3,261,545 | 7/1966 | Frazier . | |
| 3,697,030 | 10/1972 | Schultz . | |
| 3,744,081 | 7/1973 | Miller . | |
| 3,960,351 | 6/1976 | Coetzee | 248/97 |
| 3,998,415 | 12/1976 | D'Antonio et al. . | |
| 4,318,521 | 3/1982 | Martin et al. . | |
| 4,338,979 | 7/1982 | Dow . | |
| 4,550,440 | 10/1985 | Rico . | |
| 4,664,348 | 5/1987 | Corsault, III et al. | 248/99 |
| 4,805,858 | 2/1989 | Taylor . | |
| 4,848,709 | 7/1989 | Kiniry . | |
| 4,955,566 | 9/1990 | Bolich . | |
| 4,981,274 | 1/1991 | McVay et al. | 248/97 |
| 5,149,028 | 9/1992 | Blackaby et al. . | |

*Primary Examiner*—Ramon O. Ramirez
*Attorney, Agent, or Firm*—Jacobson, Price, Holman & Stern

[57] ABSTRACT

A support frame device is designed for the purpose of holding the rim of a plastic lawn or trash bag in an open upright or ground level position to receive refuse. The device facilitates collecting leaves, and lawn debris on uneven terrain and has a dust-pan type entry ramp whereby finer and dangerous materials found along side streets, alleyways, and gutters, such as broken glass, discarded needles and the like can be collected.

6 Claims, 2 Drawing Sheets

LAWN REFUSE BAG HOLDER

BACKGROUND OF THE INVENTION

The present invention relates to a lawn refuse bag holder which is uniquely constructed and versatile for many types of uses.

When collecting refuse for disposal, it is desirable to collect the refuse into a bag, which may be carried to a disposal site, or picked up for disposal. A device to hold the bag open to facilitate loading is very useful. While there are several bag holding devices known in the art, there is room for improvement.

SUMMARY OF THE INVENTION

It is an object of this invention to provide a device to support the mouth of a plastic bag in an open position to facilitate the filling thereof. In particular, this invention is adaptable to most any type of surface or terrain by means of adjustable supports designed for this purpose. While many bag holders are designed for a particular purpose, few have attained the multiple advantages of this invention. To be specific, this invention relates to an easily portable bag holder that is self contained, that can be used to its fullest extent in a variety of ways. In one embodiment the bag holder is vertically positioned on a hard flat surface so that the debris from street and gutters can be directed into the bag by broom or the like. The bottom horizontal edge of the device has a ramp-like lip thereby giving the holder a dust-pan type approach providing a more positive contact with the surface enabling the bag holder to more readily receive sweeping's or finer materials such as dust, dirt, sawdust, wood shavings and the like. Additionally, by repositioning spike-like bag holder supports, this invention can be anchored in the ground in an upright position at ground level so that bulky material such as leaves, grass and hedge clippings may be swept into the bag. It is a further object of this invention to provide vertical support for plastic bags, allowing trash to be placed in the bag from above the bag opening. This is accomplished with the aid of a vertical or wall mounted holding system designed to accommodate the bag holder in a horizontal position.

BRIEF DESCRIPTION OF THE DRAWINGS

The accompanying drawings illustrate a preferred embodiment of the invention.

DESCRIPTION OF PREFERRED EMBODIMENT

Figure 1:
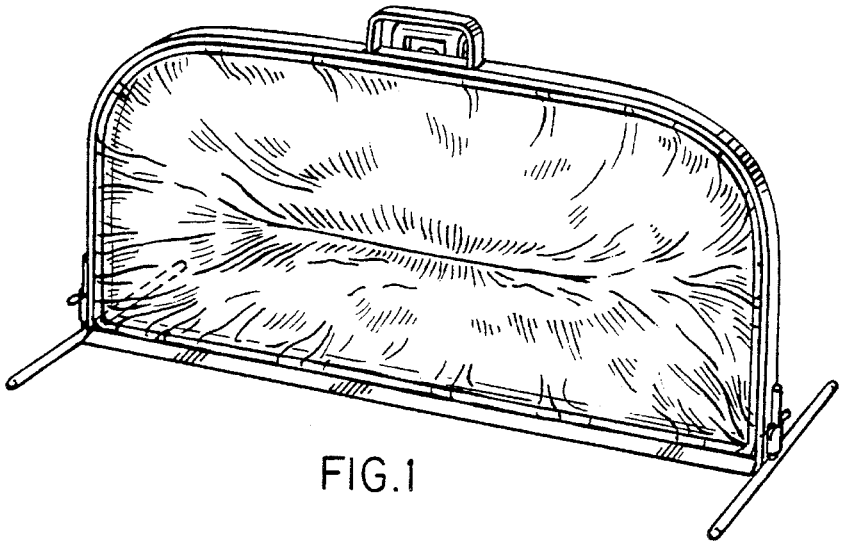
FIG. 1 is a perspective view of the inventive bag holder in an operative position on a flat surface.
Figure 2:
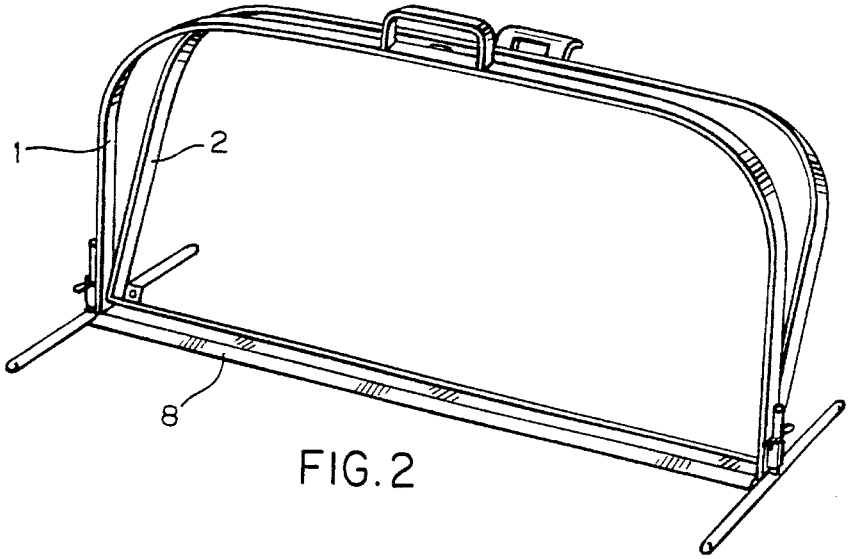
FIG. 2 shows the bag holder of the preferred embodiment in a near closed position.
Figure 3:
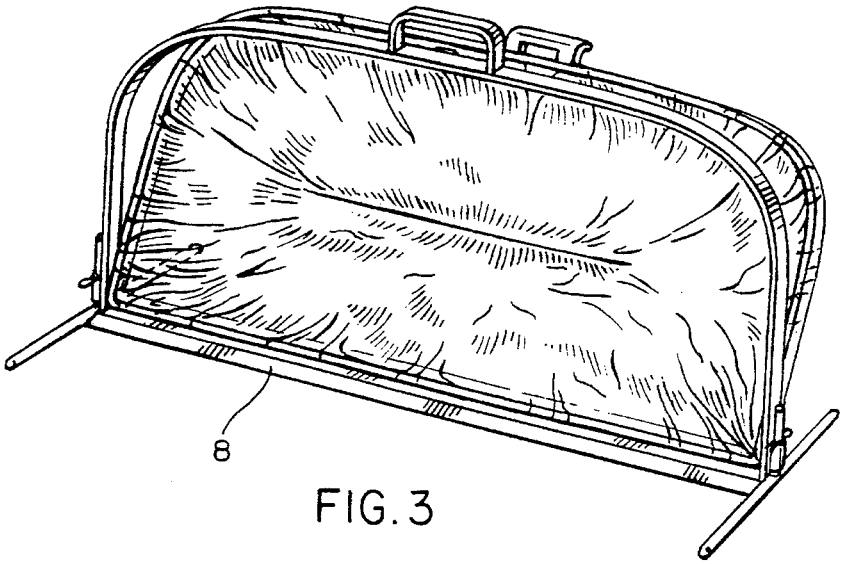
FIG. 3 shows a plastic bag installed on the movable frame in a near closed position.
Figure 4:
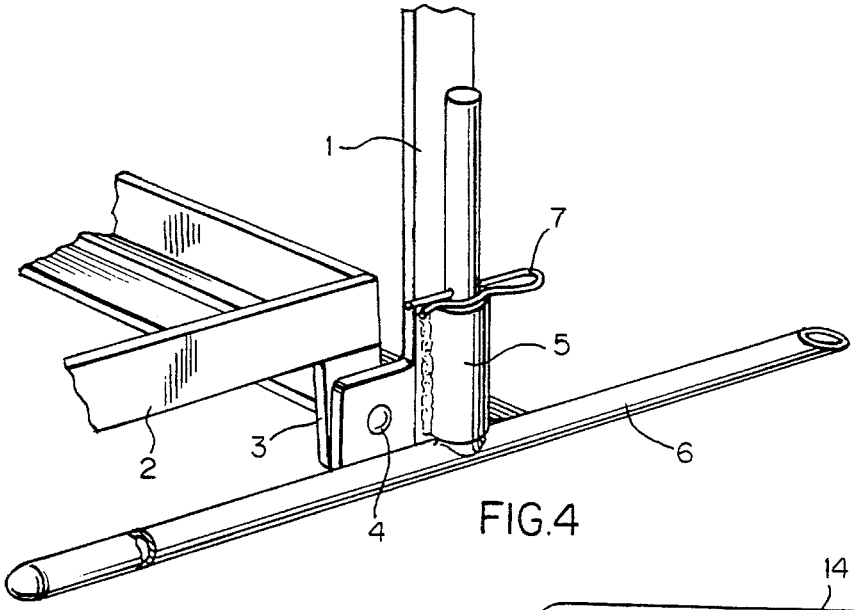
FIG. 4 is an enlarged perspective view of a corner assembly detailing an offset hinge arrangement as well as a support system positioned for use on a flat surface.

In the details of construction, this invention consists of having inner and outer interfitting mutually pivoted rectangular frames 1 and 2 formed of a ridged material, secured together by rivets 4 in FIG. 4. The outer support frame 1 consists of four sides with its corresponding closely fit movable inner frame 2 making up the preferred embodiment of the bag holder. The movable frame 2 is of such dimension as to accommodate the standard dimensions of the open mouth of a plastic bag with a tight fit. As the thickness of plastic material used in lawn bags is of minute dimension, movable inner frame should be close to a press fit within the support frame in order to tightly secure the folded back edges of the bag when the holder is in a closed position.

The offset pivot point type hinge arrangement 3 in FIG. 4 between the stationary frame and the movable frame allows for the surface of the movable frame to be exposed in its entirety when in an open position, thus allowing for a plastic bag to be easily inserted open end up from the underside frame opening and draped or folded outwardly over the movable frame. By positioning the movable frame in a closed position in the stationary frame it thereby traps the plastic bag with its mouth in an open position.

Figure 5:
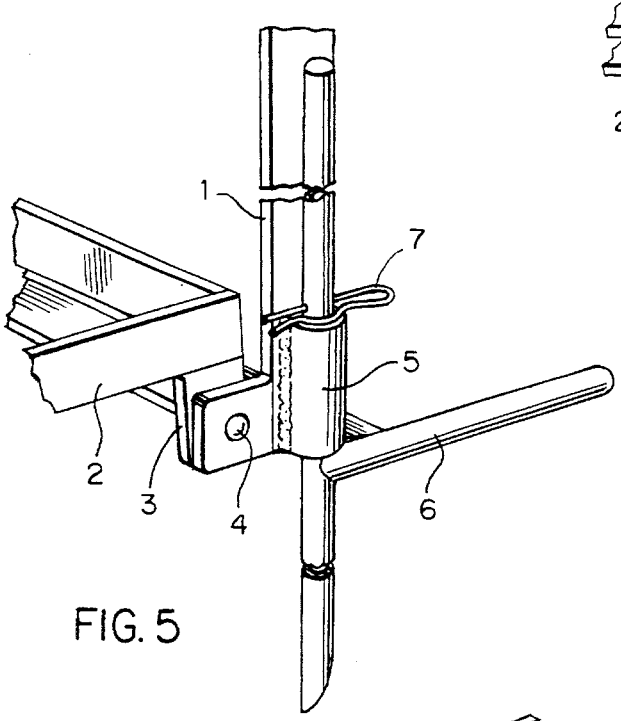
FIG. 5 shows the support system positioned for yard use on uneven terrain.

The support system embodiment as shown in FIG. 4 consists of a T-shaped bar 6 fitting in a U-shaped elongated type socket 5 formed to proper size and secured to the bottom of the holding frame. The female component is sized to accommodate the male T-shaped bar support assembly 6 enabling the support system when positioned with the cross-bar of item 6 horizontal as shown in FIG. 4 to stand in an upright stable position on a flat surface. By removing a clasp pin 7 and repositioning the T-bar a quarter turn a spike-like member at one end of the T-bar is now in a position to anchor the bag holder in uneven terrain in an upright position to receive refuse as seen in FIG. 5.

Figure 6:
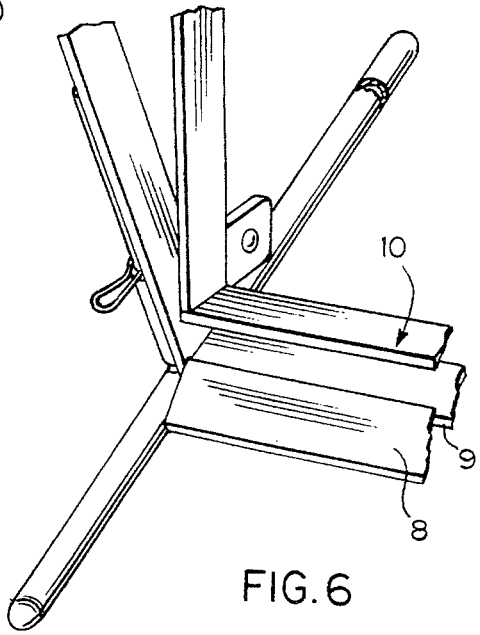
FIG. 6 is an enlarged perspective view of the leading edge dustpan ramp to the bag holder.

FIG. 6 shows the incorporation of a ramp-like support member 8 fastened at intervals along the front edge of the stationary frame 1. Not only does this add to the strength of the stationary frame base but provides the bag holder with a sloped entry 8, thus the dust-pan approach, elevating the material directly over the leading edge 10 of the plastic bag trapped against it by the movable frame in a closed position, thereby making the entrapment more secure.

Figure 7:
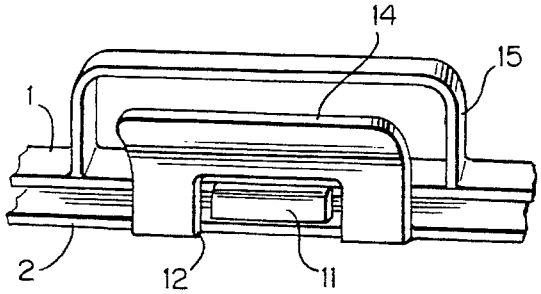
FIG. 7 shows a push-pull latch device.

The interlocking relationship between the catch bar on the support structure and the movable frame in a closed position is shown in FIG. 7. With regards to item 11 a small bar of metal, secured on the edge of the support structure 1 directly opposite the opening 12 in the release lever 14 serves as a catch, making up a latching device when the movable frame is moved into a closed position, forcing the catch bar over the edge of the movable frame 2 and into the opening of the release lever thereby dropping over the edge of the movable frame and securing it in a closed position. A handle 15 attached to the outer frame of the support structure 1 not only serves as a carrying device but also, with the aid of the release lever 14 assists with the latching and unlatching of the holder in a simple push-pull motion.

Figure 8:
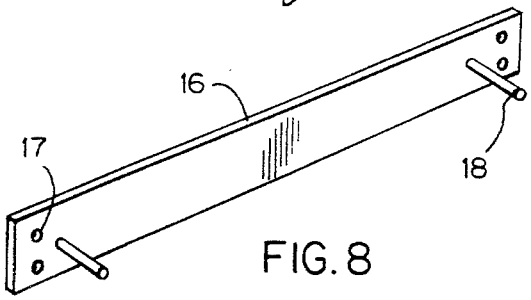
FIG. 8 shows a vertical mounted holding system.

Another aspect of this invention is the wall mounted holding system (FIG. 8) for supporting the bag holder in a horizontal position, thus accommodating the lawn bag in a vertical position for top filling. The wall mounted or vertical mounted holding system consists of a mounting flat plate 16 bored at 17 for mounting screws with two stud type supports 18 ridgedly attached at both ends and properly matched for inserting into the support sockets 5 of the bag holder after the T-bar brackets are removed. When properly mounted with wood screws or the like, the plastic bag held by the bag holder will rest on the floor.

This invention has been described and illustrated as to the major aspects of the device and it should be understood that the invention is not to be limited to the precise detailed herein described.

What is claimed is:

1. A device for holding the mouth of a refuse bag in an opened out condition comprising interfitting mutually pivoted inner and outer frames, the inner frame having an enclosed circumference, the outer frame having spaced uprights interconnected at upper extremities thereof by a cross-member, the inner frame being pivotally connected at a pair of opposite locations thereon to the respective uprights by pivot connections offset from the uprights whereby when the frames are opened out, the entire circumference of the inner frame is exposed to receive a folded-over mouth portion of a bag which can then be trapped between the frames when the inner frame is closed to fit within the outer frame, and mounting means at lower extremities of the uprights for supporting the device on a support surface, wherein the lower extremities of said uprights are connected by an inclined ramp-like member to facilitate sweeping of fine debris into a bag held open by the device in the manner of a dust-pan.

2. A device for holding the mouth of a refuse bag in an opened out condition comprising interfitting mutually pivoted inner and outer frames, the inner frame having an enclosed circumference, the outer frame having spaced uprights interconnected at upper extremities thereof by a cross-member, the inner frame being pivotally connected at a pair of opposite locations thereon to the respective uprights by pivot connections offset from the uprights whereby when the frames are opened out, the entire circumference of the inner frame is exposed to receive a folded-over mouth portion of a bag which can then be trapped between the frames when the inner frame is closed to fit within the outer frame, and mounting means at lower extremities of the uprights for supporting the device on a support surface, wherein the mounting means on the lower extremity of each upright comprises a female socket on the upright and a T-bar adjustably positionable in the socket, the T-bar having a vertical limb attached centrally to a cross-bar and the cross-bar having a spike at one end so that when the vertical limb is inserted in the socket from below the device can rest on the cross-bar and when another end of the cross-bar opposite said end having a spike is inserted in the socket from below, the spike can be used to anchor the device in the ground.

3. A device as claimed in claim 2, which further includes a wall-mounting plate with a pair of projecting studs adapted to fit in said sockets on removal of the T-bars to mount the device in horizontal position on a wall.

4. A device for holding the mouth of a refuse bag in an opened out condition comprising interfitting mutually pivoted inner and outer frames, the inner frame having an enclosed circumference, the outer frame having spaced uprights interconnected at upper extremities thereof by a cross-member, the inner frame being pivotally connected at a pair of opposite locations thereon to the respective uprights by pivot connections offset from the uprights whereby when the frames are opened out, the entire circumference of the inner frame is exposed to receive a folded-over mouth portion of a bag which can then be trapped between the frames when the inner frame is closed to fit within the outer frame, and mounting means at lower extremities of the uprights for supporting the device on a support surface, said device including latch means on the cross-member of the outer frame and on an adjacent portion of the inner frame for releasably clamping the frames in closed position trapping the mouth portion of a bag.

5. A device as claimed in claim 4, wherein the latch means comprises a male latch element on said cross-member of the outer frame and a complimentary U-shaped female latch element on said adjacent portion of the inner frame for frictionally holding the male latch element when the frames are closed.

6. A device as claimed in claim 5, wherein the cross-member of the outer frame is provided with a centrally located U-shaped carrying handle positioned over the latch means.

* * * * *